US008657592B2

(12) United States Patent
Bedford

(10) Patent No.: US 8,657,592 B2
(45) Date of Patent: Feb. 25, 2014

(54) PUMPING APPARATUS WITH A HOLLOW SHAFT ACTING AS A VALVE

(75) Inventor: Denis W. Bedford, Peterborough (GB)

(73) Assignee: J.C. Bamford Excavators Limited, Uttoxeter (GB)

( * ) Notice: Subject to any disclaimer, the term of this patent is extended or adjusted under 35 U.S.C. 154(b) by 655 days.

(21) Appl. No.: 12/204,678

(22) Filed: Sep. 4, 2008

(65) Prior Publication Data

US 2009/0060769 A1 Mar. 5, 2009

(30) Foreign Application Priority Data

Sep. 5, 2007 (GB) ..... 0717196.0

(51) Int. Cl.
*F01C 20/24* (2006.01)
*F04C 28/24* (2006.01)

(52) U.S. Cl.
USPC ..... 418/21; 418/16; 418/61.3

(58) Field of Classification Search
USPC ..... 418/16, 21, 61.3; 417/310
See application file for complete search history.

(56) References Cited

U.S. PATENT DOCUMENTS

| | | | | | |
|---|---|---|---|---|---|
| 3,813,187 | A * | 5/1974 | Winter | ..... | 417/310 |
| 3,930,760 | A | 1/1976 | Winter | | |
| 4,138,204 | A * | 2/1979 | Bruguera | ..... | 417/310 |
| 2007/0039782 | A1 * | 2/2007 | Bedford | ..... | 123/196 R |

FOREIGN PATENT DOCUMENTS

| | | | | | |
|---|---|---|---|---|---|
| CN | 1616825 | A | 5/2005 | | |
| EP | 1 522 730 | A1 | 4/2005 | | |
| EP | 1 529 958 | A2 | 5/2005 | | |
| GB | 816967 | | 7/1959 | | |
| JP | 6-200722 | | 7/1994 | | |
| JP | 06200722 | A * | 7/1994 | ..... | F01M 1/02 |

OTHER PUBLICATIONS

United Kingdom Search Report for GB 0717196.0, dated Dec. 12, 2007.
Search Report for EP 08 16 3593, dated Feb. 6, 2012.

* cited by examiner

*Primary Examiner* — Mary A Davis

(57) ABSTRACT

A pumping apparatus includes a pump housing, a pumping member which is rotatable in the housing to pump fluid, the pumping member being provided on a support which is in use, driven, the housing including in communication with an inlet, a lower pressure region, and in communication with an outlet, a higher pressure region, there being a passage for fluid from the higher pressure region to the lower pressure region through the support when the fluid pressure in the higher pressure region exceeds a threshold value.

20 Claims, 4 Drawing Sheets

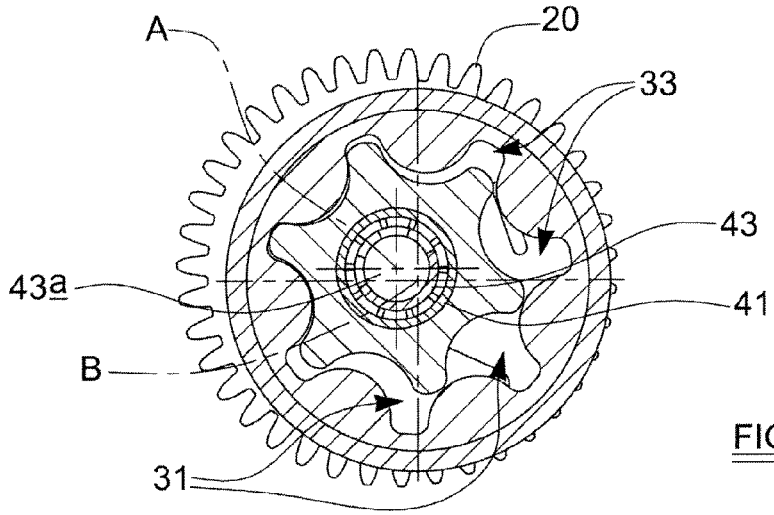
FIG 5
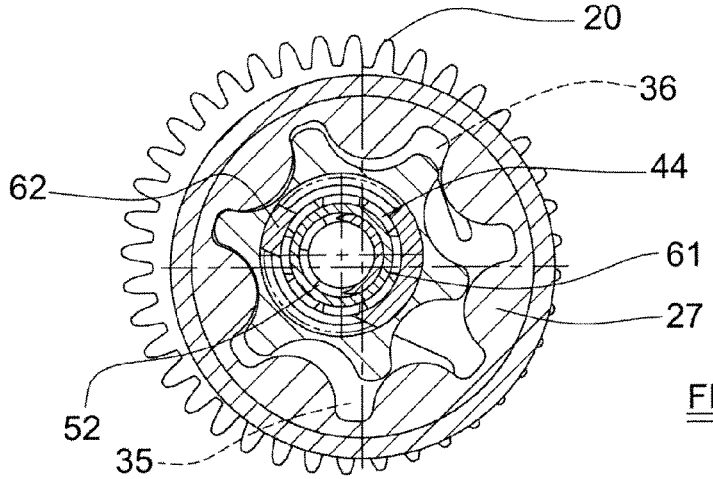
FIG 6
FIG 7
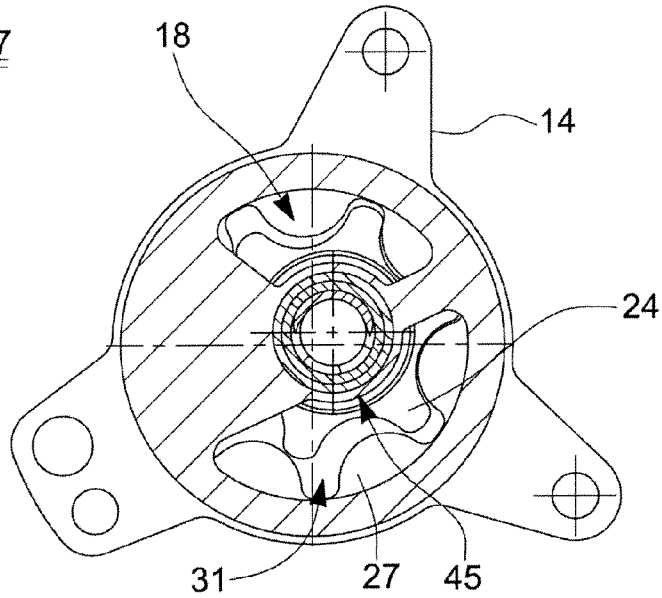

FIG 8
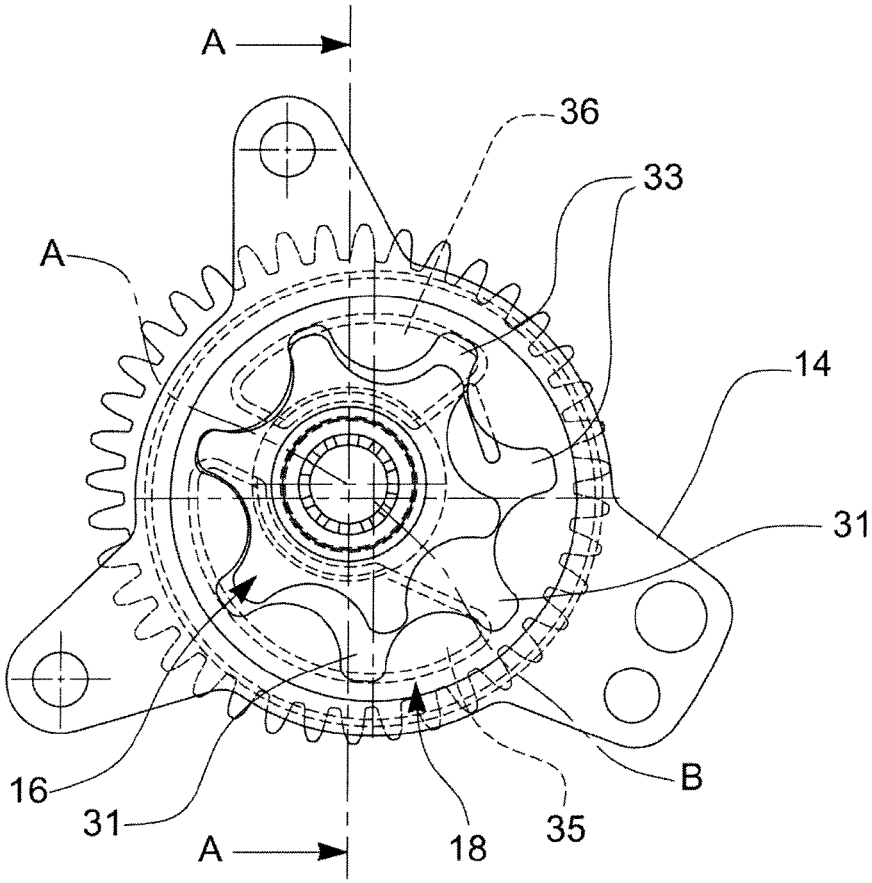
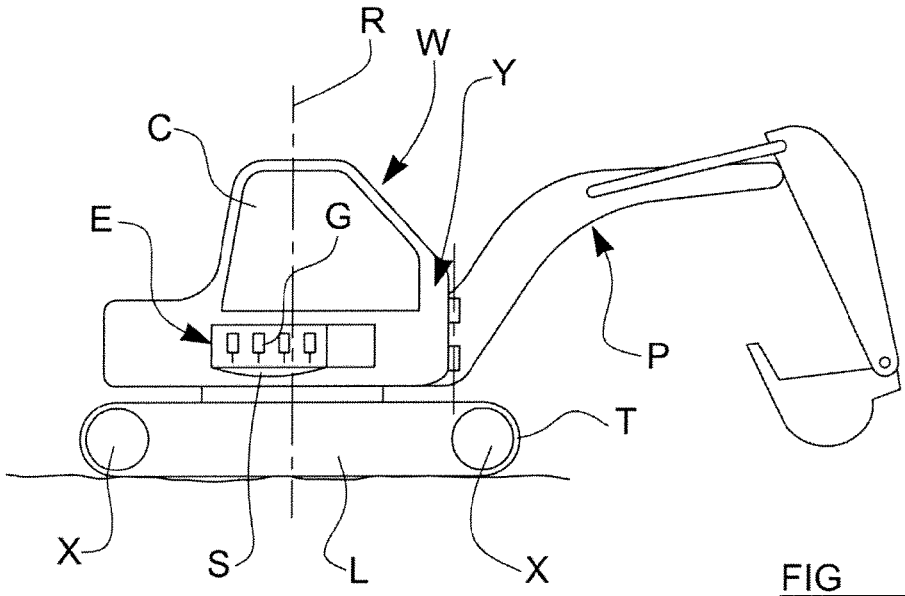
FIG 9

PUMPING APPARATUS WITH A HOLLOW SHAFT ACTING AS A VALVE

BACKGROUND TO THE INVENTION

This invention relates to a pumping apparatus. More particularly but not exclusively the invention relates to a oil pumping assembly for providing oil for lubrication in an engine. However the invention may be applied to a wide variety of other pumping apparatus which pump fluid from a lower pressure region to a high pressure region.

DESCRIPTION OF THE INVENTION

Pumping apparatus are known which include relief devices to enable any excess pressure fluid to be relieved. This in the event of the pumping apparatus providing excess fluid, and/or over pressure fluid, the high pressure is relieved. However known pumping apparatus which include such features tend to be large as such relief devices essentially are separate from the pumping components of the pumping apparatus.

SUMMARY OF THE PRIOR ART

According to a first aspect of the invention we provide a pumping apparatus including a pump housing, a pumping member which is rotatable in the housing to pump fluid, the pumping member being provided on a support which is in use, driven. The housing may include, in communication with an inlet, a lower pressure region, and in communication with an outlet, a higher pressure region. There may be a passage for fluid from the higher pressure region to the lower pressure region through the support when the fluid pressure in the higher pressure region exceeds a threshold value.

Thus in a pumping apparatus of the invention, pressure is relieved from the higher pressure to the lower pressure region via the support which is an integral pumping component. Thus a more compact pumping apparatus may be provided than a contemporary pumping apparatus.

The invention provides another advantage over conventional arrangements in which excess fluid/pressure at the higher pressure region is vented to the sump for example, because the higher pressure fluid is relieved to the lower pressure region of the pumping apparatus so that its pressure is not lost. This provides for more efficient use of the engine.

Although the invention may be applied to a wide variety of pumping apparatus types, the invention may particularly be applied to a geroter type pumping apparatus e.g. which includes in the housing, in addition to the pumping member, a reaction member, the reaction member receiving the pumping member therein, and the pumping member and reaction member being relatively rotatable in the housing to provide between them spaces. At one rotational position relative to the housing, adjacent the lower pressure fluid region inlet, as the pumping member and reaction member relatively rotate, the spaces may increase in volume thus to draw fluid into the spaces.

At another position relative to the housing, adjacent the higher pressure fluid region, as the pumping member and reaction member relatively rotate, the spaces may decrease in volume thus expelling fluid out of the spaces, towards the outlet.

Thus in one embodiment the pumping apparatus may be a geroter pumping apparatus which includes nested hypocycloid inner and outer gear elements being respectively, the pumping member and the reaction member.

Thus the pumping member may include a plurality of gear teeth which cooperate with the gear teeth of the reaction member to provide the spaces of increasing volumes as the pumping member and reaction member relatively rotate, into which fluid is drawn at the lower pressure region, and the spaces of decreasing volumes from which fluid is expelled at the higher pressure region.

The reaction member may have a differing number of gear teeth to the pumping member, i.e. more gear teeth, and the pumping member and the reaction member may be mounted in the housing so as to rotate about spaced parallel rotational axes. Desirably the pumping member is driven and the reaction member is thus rotated in the housing, by the rotating pumping member, but at a differential rotational speed to the pumping member due to the greater number of gear teeth.

The support may include a hollow shaft on which the pumping member is driven, the shaft being fixed to the pumping member and to a drive member such as a drive gear. The shaft may include a plurality of apertures which communicate on the exterior of the shaft, with the higher pressure region and the lower pressure region.

Within the hollow of the shaft there may be provided a hollow piston which may have a plurality of apertures which may communicate with the apertures of the shaft when the fluid pressure at the higher pressure region exceeds a threshold value. Desirably the housing provides a passage for fluid from the higher pressure region to bear on the piston to move the piston in the hollow of the shaft to a condition in which the respective apertures are aligned, with such movement being resisted by a resilient device such as a spring which may act between the shaft and the piston.

Thus as the fluid pressure in the higher pressure region increases, the piston will be moved against the force of the spring to the condition in which the respective apertures of the shaft and the piston are in alignment.

Desirably, the pumping member includes in an end face of the pumping member, an annular recess which surrounds the shaft and which communicates at one circumferential location with the lower pressure region and with the apertures in the support, and which recess communicates at a second circumferential location with the higher pressure region and with the apertures of the support, so that the fluid may pass from the higher pressure region to the support, and when the apertures of the support and the piston are aligned, through the support to the lower pressure region. The housing may include first and second bridge parts which are received in the annular recess at generally radially opposite locations to prevent the flow of fluid from the higher pressure region to the lower pressure region via the recess without passing through the support.

The housing of the pumping apparatus may include a first part which provides for the inlet connections from the lower pressure region to a fluid source, and an outlet connection from the higher pressure region to a delivery connection, and a second part which at least substantially contains the pumping member, and the reaction member where provided.

According to a second aspect of the invention we provide a working machine which includes a ground engaging structure by means of which the machine is moveable over the ground, a working arm which includes a working implement for performing working operations, an engine for providing power at least for driving the machine, and wherein the engine is lubricated by lubricant pumped by a pumping apparatus according to the first aspect of the invention.

BRIEF DESCRIPTION OF THE DRAWINGS

Embodiments of the invention will now be described with reference to the accompanying drawings in which:—

FIG. 5 is a cross section on the line D-D of FIG. 2;

FIG. 6 is a cross section on the line E-E of FIG. 2;

FIG. 7 is a cross section on the line G-G of FIG. 2;

FIG. 8 is a front view of the apparatus of FIG. 2 with the first housing part removed;

FIG. 9 is an illustrative view of a working machine including the pumping apparatus of the previous figures.

DESCRIPTION OF THE PREFERRED EMBODIMENTS

Figure 1:
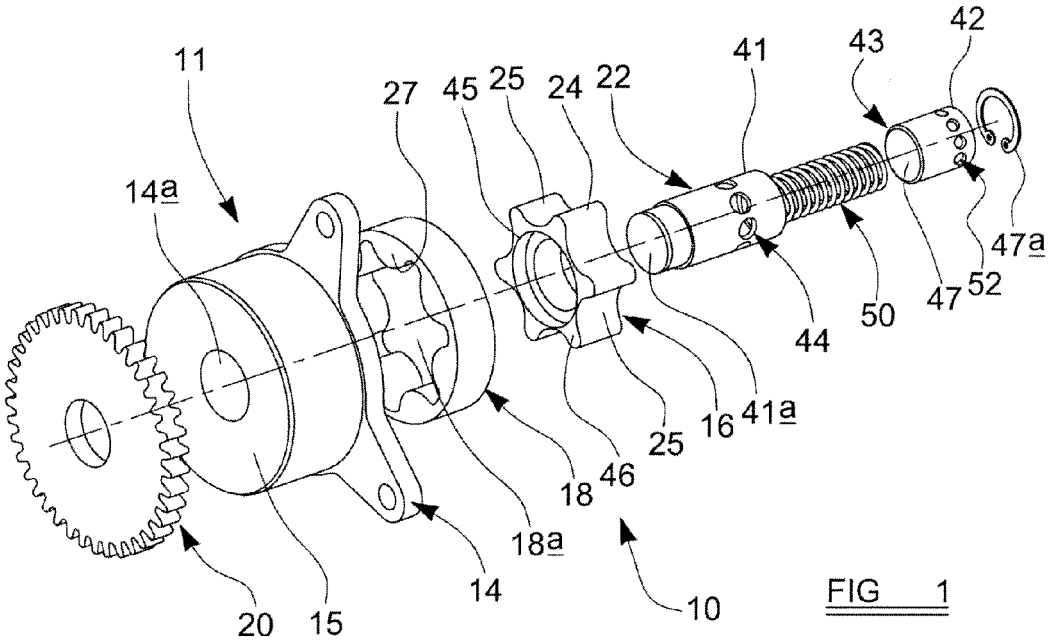
FIG. 1 is an exploded perspective view of a part of a pumping apparatus in accordance with the invention, excluding a first housing part.

Referring to the drawings a pumping apparatus 10 includes a housing 11 which is mounted for example, in an engine compartment of a vehicle or machine, the housing 11 including a first part 12 which provides an inlet connection 12*a* to a fluid source such as an oil sump S of an engine E (see FIG. 9), and an outlet connection 12*b* to galleries G of the engine E which require lubricant.

The housing 11 includes a second part 14 in which are received for rotation, a pumping member 16 and a reaction member 18, the pumping member 16 being received in an opening 18*a* of the reaction member 18.

The reaction member 18 is constrained by the housing 12 to rotate about a first rotational axis A, whilst the pumping member 16 is relatively eccentrically mounted for rotation about a second rotational axis B which is displaced relative to axis A, but is generally parallel to the axis A. In this example, the pumping member 16 is driven by a gear 20 from a prime mover, such as an output gear from a driven shaft of the engine E, there being a support 22 which carries the pumping member 16 and is connected for driving to the gear 20, through an opening 14*a* provided in a base 15 of the second housing part 14.

The pumping member 16 includes a plurality of lobular gear teeth, in this example six teeth 24 which provide between them, recesses 25. The opening 18*a* of the reaction member 18 includes seven corresponding lobular gear teeth 27, each of which may, at some positions of rotation at least relative to the pumping member 16, be received in a recess 25 between a pair of the gear teeth 24 of the pumping member 16. In the example, which shows the pumping member 16 and the reaction member 18 in one relative position, the tooth of the pumping member 16 which is indicated at 24*a* is wholly received in a recess between a pair of the gear teeth 27*a*, 27*b* of the reaction member 18. As the pumping member 16 and reaction member 18 relatively rotate further, both in an anti-clockwise direction as seen in the drawings, due to their displaced axes of rotation B, A respectively, the gear tooth 24*a* of the pumping member 16 will disengage the recess between teeth 27*a*, 27*b* of the reaction member 18 so that when the pumping member 16 has rotated 180°, the tooth 24*a* will have rotated to the position 24*b* shown where it lies adjacent the tooth indicated at 27 of the reaction member 18 as the reaction member 18 will not have rotated the same amount.

It will be appreciated that by driving the pumping member 16, by virtue of a gear tooth 24*a* of the pumping member 16 always being fully received by a recess between teeth 27 of the reaction member 18 where the axis of rotation A of the pumping member 16 is closest to an inner wall 14*b* of the second housing part 14, the reaction member 18 will be driven by the pumping member 16 in the same rotational direction, but at a differential rotational speed as the pumping member 16, due to the additional tooth 27.

Thus the pumping apparatus 10 shown and described is a geroter pumping apparatus of the nested hypocycloid kind, with the pumping member 16 being an inner nested geared element and the reaction member 18 being an outer nested geared element.

Moreover as the pumping member 16 and reaction member 18 relatively rotate about their respective axes A, B, at a location to one side of a line indicated at D, first spaces 31 of increasing size as the pumping member 16 and reaction member 18 relatively rotate, will be provided between the pumping member 16 and the reaction member 18, whilst at a location to the other side of the dividing line D, second spaces 33 of decreasing size as the pumping member 16 and reaction member 18 relatively rotate will be provided.

As will be explained below, the fluid pressure in the first spaces 31 is lower pressure fluid, whilst the fluid pressure in the second spaces 33 is higher pressure fluid.

The first spaces 31 each communicate with the inlet connection 12*a* to the fluid source S and thus this is the pump apparatus 10 fluid inlet. The second spaces 33 communicate with the outlet connection 12*b* to the engine galleries G or other equipment to be fed the fluid e.g. for lubrication, and thus this connection 12*b* is the pump apparatus 10 outlet.

It will be appreciated that as the pumping member 16 and reaction member 18 relatively rotate as described, fluid will be drawn into or flow into the low pressure region of the pumping apparatus i.e. first spaces 31 as first spaces 31 volumes increase, and fluid will be expelled from the second spaces 33 as the second spaces 33 volumes decrease.

The first and second housing parts 12, 14 provide a low pressure region inlet port 35 which extends to either side of the pumping member 16 and which is connected to the inlet connection 12*a* to the fluid source S and to the inlet spaces 31, and a higher pressure regions outlet port 36 which extends to either side of the pumping member 16 and which is connected to the outlet connection 12*b*.

According to the invention, in the event that the fluid pressure in the outlet port higher pressure region 36 increases above a threshold, there is a path for the high pressure fluid to the low pressure region of the inlet port 35 to relieve the excess pressure, through the support 22 which will now be described.

The support 22 includes a hollow shaft 41 which extends through and is fixed to the pumping member 16, and extends through the opening 14*a* in the base of the second housing part 14, and is fixed to gear 20.

The shaft 41 includes a plurality of circumferentially spaced apertures 44 which lie adjacent to an annular recess 45 which is provided in the pumping member 16 in a face 46 thereof which faces inwardly of the second housing part 14*a*. The circumferential recess 45 of the pumping member 16 communicates with, on the one hand the lower pressure region 35, and on the other hand with the higher pressure region 36.

The second housing part 14 includes formations which are received in the annular recess 45 to prevent the flow of fluid from the higher pressure region 36 to the lower pressure region 35 other than through the support 22. These formations include a first bridge part 61 (best seen in FIG. 6) which at one circumferential location is received in and closes the annular recess 45, and a second bridge part 62 which is received in and closes the annular recess 45 at a second circumferential location. Between the bridge parts 61, 62, the annular recess 45 communicates with, on the one hand the lower pressure region 35 and on the other hand with the higher pressure region 36.

However, below a threshold pressure, fluid flow into the hollow of the shaft 41 through the apertures 44 in the support 22 is prevented by a piston 43 which is slidable axially inside the hollow of the shaft 41. The piston 43 has a closed end 42 and an internal hollow 47, and there is a compression spring 50 provided in the hollow 47 of the piston 43 which acts between a closed end 41*a* of the shaft 41 and the closed end 42 of the piston 43, to urge the piston 43 outwardly of the hollow of the shaft 41. The piston 43 is prevented from being urged fully outwardly of the hollow of the shaft 41 by a circlip 47*a*, although the piston 43 might alternatively bear on a bearing part of the first housing part 12 as required.

Figure 2:
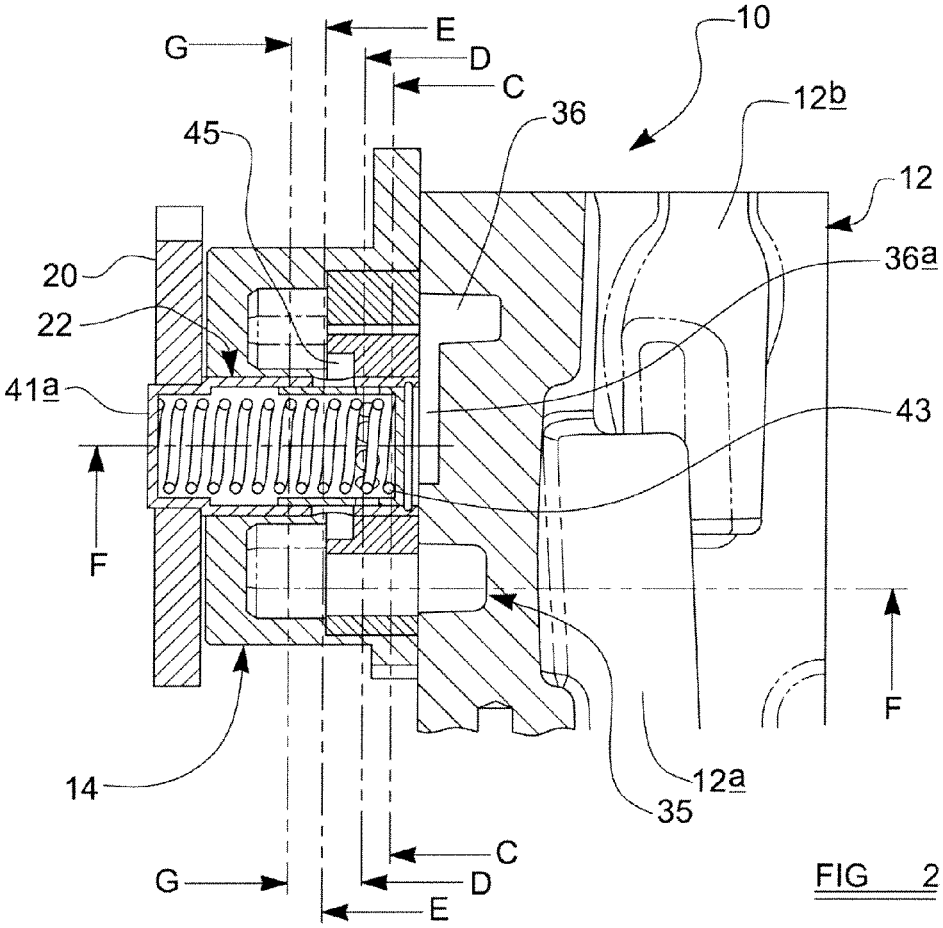
FIG. 2 is a cross sectional view on the line A-A of FIG. 8 of the apparatus of FIG. 1 shown assembled complete with the first housing part.
Figure 3:
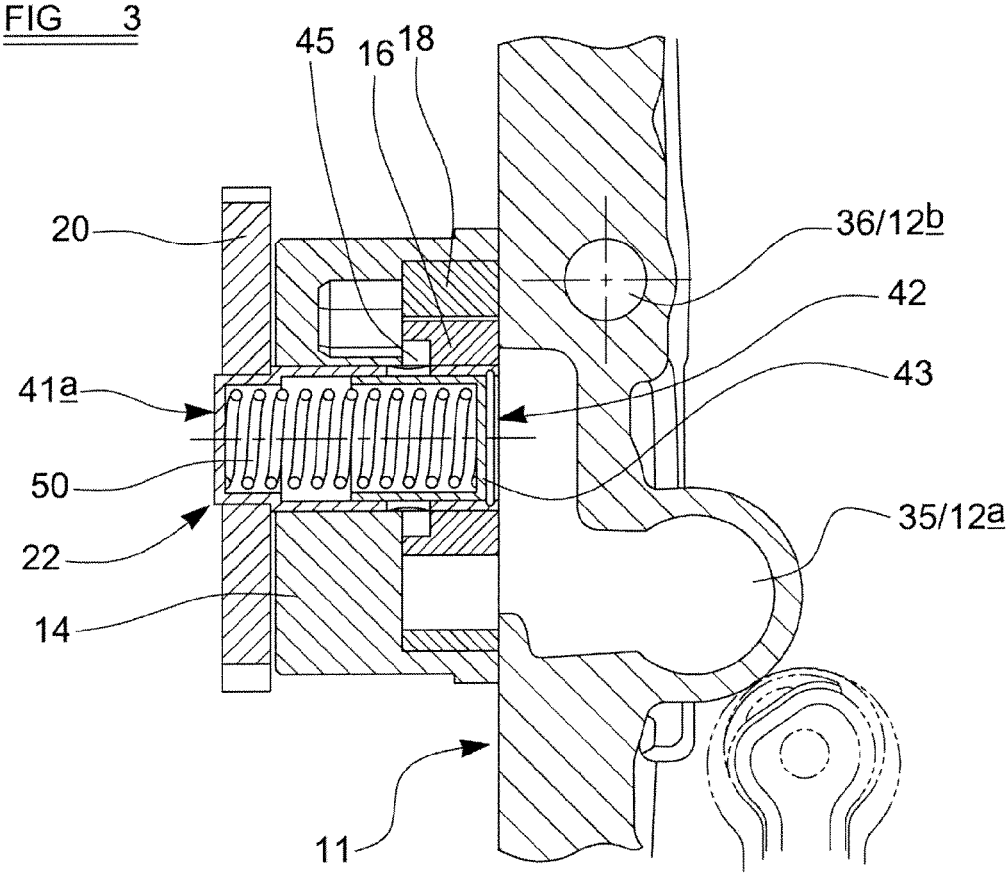
FIG. 3 is a cross section on the line F-F of FIG. 2.
Figure 4:
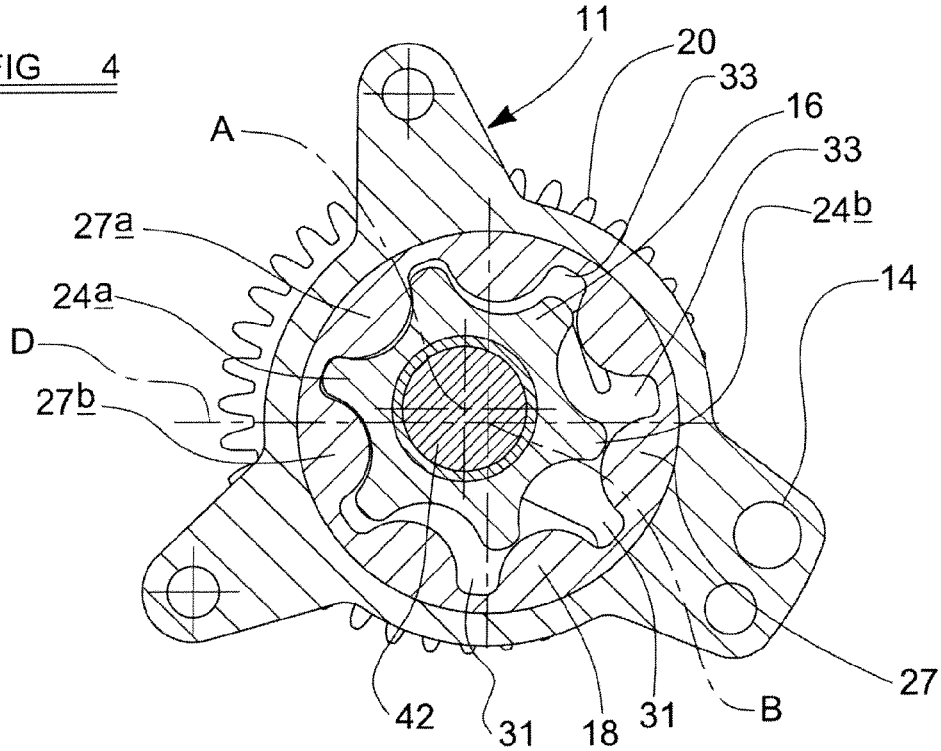
FIG. 4 is a cross section on the line C-C of FIG. 2.

It can be seen from FIG. 2 that the higher pressure region outlet port 36 includes a passage 36*a* which extends to a position of the first housing part 12 adjacent the closed end 42 of the piston 43. Thus the fluid of the higher pressure outlet region 36 bears on the closed end 42 of the piston 43 to urge the piston 43 against the force of the spring 50, inwardly of the hollow of the shaft 41.

The piston 43 includes a plurality of circumferentially spaced apertures 52 to the internal hollow 47 of the piston 43 which desirably correspond in number and size to the apertures 44 of the shaft 41. If the piston 43 is urged inwardly of the hollow of the shaft 41 sufficiently, the apertures 52 of the piston 43 and the apertures 44 of the shaft 41 will therefore align, and thus a fluid flow path will be provided through the support 22 from the annular recess 45 between the bridge parts 61, 62 which communicate with the higher pressure region 36, to the annular recess 45 between the bridge parts 61, 62 which communicate with the lower pressure region 35 so that higher pressure fluid from the higher pressure region 36 can be relieved to the lower pressure region 35.

It will be appreciated that there will be a metering effect in that initially as the apertures 44, 52 first align, only a small flow of fluid through the support 22 will be permitted, but as the outlet pressure increases, the apertures 44, 52 will more fully align allowing a maximal flow of fluid from the higher pressure region 36 to the lower pressure region 35.

By virtue of the flow path for fluid from the higher pressure region 36 to the lower pressure region 35 through the support 22 as described, a very compact pumping apparatus 10 for its pumping rating may be provided.

Various modifications may be made without departing from the scope of the invention.

The configuration of the pumping apparatus 10 shown is purely exemplary. In the example, the first housing part 12 closes the second housing part 14, and in the manner of a manifold provides formations for the lower pressure region inlet 35 and higher pressure region outlet 36 ports, as well as the connections 12*a* and 12*b* to respectively the fluid source S and engine galleries G to be lubricated. In another example, the pumping apparatus 10 may be differently configured to contain the pumping member 16 and the reaction member 18 and to provide inlet and outlet ports 35, 36.

In the example, the pumping member has six gear teeth 24 and the reaction member 18 seven teeth 27, but in another configuration different numbers of teeth 24 and 27 may be provided, although with a nested hypocycloid type pumping apparatus 10 as described, the reaction member 18 would require at least one additional tooth 27 to the pumping member 24.

Although the invention has been described in relation to a geroter pumping apparatus 10 of the nested hypocycloid type, the invention may be applied to other geroter pumping apparatus or indeed to any pumping apparatus which include a pumping member 16 which rotates, with or without a reaction member 18, in a housing 11 to perform pumping between a lower pressure region and a higher pressure region. For example the invention may be applied to a gear pump which includes a pair of meshing gear elements, the fluid flow path from the higher pressure region to the lower pressure region being through a support of at least one of the meshing gears.

In each case though, a flow path for fluid is provided from a higher pressure region to a lower pressure region through the support 22 which carries the or a pumping member 16, at least when the outlet pressure exceeds a threshold pressure.

The invention has been described in relation to a fluid pumping apparatus for pumping lubricant for an engine E and in FIG. 9, the engine E is seen to be an engine by way of example only, for a working machine W which includes a body Y which includes the engine E compartment and a cab C, mounted for rotation about an upright axis R on a ground engaging structure L which in the example includes a continuous track T driven by wheels X. In the example of FIG. 9, the machine W has a working arm P with a working implement, configured for excavating. However the invention may be applied to a wide variety of working machines and other vehicles, including automotive vehicles, as required, for pumping lubricant. However the invention may be used for pumping apparatus which pump other fluids than lubricant.

The invention claimed is:

1. A pumping apparatus including:

a pump housing, the pump housing including a low pressure region in communication with an inlet and a higher pressure region in communication with an outlet, a driveable support, a pumping member, the pumping member arranged to be rotatable in the pump housing to pump fluid, the pumping member being coupled to the driveable support, the pump housing including a passage providing flow communication from the higher pressure region to the lower pressure region through the driveable support, the passage arranged to be opened when the fluid pressure in the higher pressure region exceeds a threshold value, a piston slidable axially within the driveable support, the piston having a closed end and an internal hollow, wherein fluid at the higher pressure region bears on the closed end, and a biasing element provided in the internal hollow and configured to act between the closed end and the driveable support.

2. The pumping apparatus according to claim 1 wherein the driveable support comprises a hollow shaft, the hollow shaft coupled to the pumping member and to a drive member.

3. The pumping apparatus according to claim 2 wherein the hollow shaft includes a first plurality of apertures which provide flow communication between the low pressure region and an interior of the hollow shaft.

4. The pumping apparatus according to claim 3, the piston including a second plurality of apertures in communication with the internal hollow, the piston arranged to shift from a closed position to an open position in response to fluid pressure at the higher pressure region exceeding the threshold value, the second plurality of apertures arranged to cooperate with the first plurality of apertures to provide flow communication between the low pressure region and the higher pressure region when the hollow piston shifts to the open position.

5. The pumping apparatus according to claim 4, wherein the biasing element is positioned to bias the piston resiliently toward the closed position, and wherein a further passage is configured to allow fluid from the higher pressure region to bear on the hollow piston to move the piston toward the open position.

6. The pumping apparatus according to claim 4 wherein the pumping member includes an end face having an annular recess which surrounds the hollow shaft and which communicates at a first circumferential location with the low pressure region and with the first plurality of apertures, the annular recess further arranged to communicate at a second circumferential location with the higher pressure region and with the first plurality of apertures, wherein the first and second circumferential regions are separated by formations which prevent the flow of fluid from the higher pressure region to the low pressure region other than through the hollow shaft when the piston is in the open position.

7. The pumping apparatus according to claim 6 wherein the formations comprise first and second bridge parts which are received in the annular recess at generally radially opposite locations.

8. The pumping apparatus according to claim 1 wherein the pump housing of the pumping apparatus includes a first part which operatively couples the inlet to a fluid source, and an outlet connection which operatively couples the outlet to a delivery connection, and a second part which contains the pumping member.

9. The pumping apparatus according to claim 1, wherein the pumping apparatus includes a reaction member disposed in the pump housing, the reaction member having an opening arranged to receive the pumping member therein, wherein the pumping member and the reaction member are relatively rotatable in the pump housing to create spaces therebetween.

10. The pumping apparatus according to claim 9, wherein the pumping member includes a first plurality of lobular gear teeth, and wherein the opening of the reaction member includes a second plurality of lobular gear teeth, each of the second plurality of lobular gear teeth separated from a next adjacent gear tooth by a recess, the second plurality greater than the first plurality.

11. The pumping apparatus according to claim 10, wherein, in response to relative rotation between the pumping member and the reaction member, the pumping member and the reaction member are arranged to form a space between a selected one of the plurality of first lobular gear teeth and a selected one of the plurality of second lobular gear teeth, and wherein the space moves relative to the pump housing in response to rotation of the pumping member and the reaction member relative to the pump housing, and wherein a volume of the space increases adjacent a first rotational position relative to the pump housing to draw fluid into the space from the inlet, and wherein the volume of space decreases at a second rotational position relative to the pump housing to expel fluid out of the spaces toward the outlet.

12. The pumping apparatus according to claim 9, wherein the pumping member comprises an inner hypocycloid gear and the reaction member comprises an outer hypocycloid gear, and wherein the pumping member is nested within the opening of the reaction member.

13. The pumping apparatus according to claim 12 wherein the inner hypocycloid gear includes a first plurality of gear teeth and the outer hypocycloid gear includes a second plurality of gear teeth, and wherein the first plurality of gear teeth cooperate with the second plurality of gear teeth to provide spaces, the spaces having increasing volumes followed by decreasing volumes as the pumping member and reaction member rotate relative to one another, such that fluid is drawn from the low pressure region into the spaces having increasing volumes, and fluid is expelled toward the higher pressure region from the spaces having decreasing volumes.

14. The pumping apparatus according to claim 13 wherein the pumping member is mounted in the pump housing to rotate about a first axis and the reaction member is mounted in the pump housing to rotate about a second axis, and wherein the first and second axes are spaced and parallel.

15. The pumping apparatus according to claim 14 wherein the pumping member is driven by the driveable support and causes the reaction member to be rotated in the pump housing, and wherein the second plurality of gear teeth is greater than the first plurality of gear teeth, such that the pumping member rotates faster than the reaction member.

16. The pumping apparatus according to claim 1 wherein the driveable support has a closed end and the biasing element acts between the closed end of the driveable support and the closed end of the piston to urge the piston outwardly of the driveable support.

17. The pumping apparatus of claim 1, wherein the pumping apparatus is arranged such that the fluid pressure in the higher pressure region bears on the closed end and urges the piston against the force of the biasing element to open the passage when the threshold value is exceeded.

18. A pumping apparatus including:

a pump housing, the pump housing including a low pressure region in communication with an inlet and a higher pressure region in communication with an outlet, a driveable support, a pumping member, the pumping member arranged to be rotatable in the housing to pump fluid, the pumping member being coupled to the driveable support, the pump housing including a passage providing flow communication from the higher pressure region to the low pressure region through the driveable support, the passage arranged to be opened when the fluid pressure in the higher pressure region exceeds a threshold value, and a reaction member disposed in the pump housing, the reaction member having an opening arranged to receive the pumping member therein, wherein the pumping member and reaction member are relatively rotatable in the pump housing to create spaces therebetween; and further comprising a piston disposed in the driveable support, and wherein the pumping member includes an annular recess which surrounds the driveable support and which communicates at a first circumferential location with the low pressure region and with at least one aperture in the driveable support, and wherein the annular recess communicates at a second circumferential location with the higher pressure region and with the at least one aperture of the driveable support, and including formations received by the annular recess to prevent the flow of fluid from the higher pressure region to the low pressure region other than through the driveable support, the at least one aperture in the driveable support forming a portion of the passage for the flow of fluid from the higher pressure region to the low pressure region through the driveable support, the passage being opened and closed by movement of the piston relative to the driveable support.

19. A pumping apparatus including:

a pump housing including a low pressure region in communication with an inlet and a higher pressure region in communication with an outlet;

a driveable support comprising a hollow shaft;

a rotatable pumping member disposed in the pump housing and coupled to the driveable support, the pumping member disposed in an opening of a rotatable reaction member disposed in the pump housing, the pumping member and the reaction member arranged to draw fluid from the fluid inlet and expel fluid toward the fluid outlet in response to rotation of the driveable support;

a fluid passage extending from the low pressure region to the higher pressure region through the hollow shaft;

a valve assembly carried by the hollow shaft, the valve assembly comprising:

a plurality of apertures formed in the hollow shaft and positioned to provide flow communication between the low pressure region to an interior of the hollow shaft;

a hollow piston disposed within the hollow shaft, the hollow piston including a plurality of flow apertures, the hollow piston arranged to shift from a closed position closing the passage to an open position opening the passage in response to fluid pressure at the higher pressure region exceeding a threshold value; and the plurality of flow apertures of the hollow piston arranged to cooperate with the plurality of apertures on the hollow shaft when the hollow piston is in the open position to provide flow communication along the passage through the interior of the hollow shaft;

wherein the pumping member includes a first plurality of lobular gear teeth and the reaction member includes a second plurality of lobular gear teeth, and wherein the pumping member and the reaction member are arranged to form a space between a selected one of the first plurality of lobular gear teeth and a selected one of the second plurality of lobular gear teeth, and wherein the space moves relative to the pump housing in response to rotation of the pumping member and the reaction member relative to the pump housing, and wherein a volume of the space increases adjacent a first rotational position relative to the pump housing to draw fluid into the space from the inlet, and wherein the volume of space decreases at a second rotational position relative to the pump housing to expel fluid out of the spaces toward the outlet; and wherein the pumping member includes an end face having an annular recess which surrounds the hollow shaft and which communicates at a first circumferential location with the low pressure region and with the apertures in the hollow shaft, the annular recess further arranged to communicate at a second circumferential location with the higher pressure region and with the apertures of the hollow piston, wherein the first and second circumferential locations are separated by a first bridge and a second bridge which prevent the flow of fluid from the higher pressure region to the low pressure region other than through the hollow shaft when the hollow piston is in the open position.

20. The pumping apparatus of claim 19, wherein the first and second bridges are received in the annular recess at generally radially opposite locations to prevent the flow of fluid from the higher pressure region to the low pressure region via the annular recess without passing through the valve assembly.

* * * * *